US008450992B2

(12) United States Patent
Tesu et al.

(10) Patent No.: US 8,450,992 B2
(45) Date of Patent: May 28, 2013

(54) WIDE-SWING CASCODE CURRENT MIRROR

(75) Inventors: Ion C. Tesu, Austin, TX (US); Riad Wahby, Austin, TX (US)

(73) Assignee: Silicon Laboratories Inc., Austin, TX (US)

( * ) Notice: Subject to any disclaimer, the term of this patent is extended or adjusted under 35 U.S.C. 154(b) by 602 days.

(21) Appl. No.: 12/495,412

(22) Filed: Jun. 30, 2009

(65) Prior Publication Data

US 2010/0327843 A1 Dec. 30, 2010

(51) Int. Cl.
*G05F 3/16* (2006.01)
*G05F 3/20* (2006.01)

(52) U.S. Cl.
USPC ..... 323/315

(58) Field of Classification Search
USPC ..... 323/315, 316, 317
See application file for complete search history.

(56) References Cited

U.S. PATENT DOCUMENTS

2005/0083029 A1* 4/2005 Moraveji ..... 323/315
2007/0200545 A1* 8/2007 Loi et al. ..... 323/315

* cited by examiner

*Primary Examiner* — Harry Behm
*Assistant Examiner* — Matthew Grubb
(74) *Attorney, Agent, or Firm* — O'Keefe, Egan, Peterman & Enders LLP

(57) ABSTRACT

A current mirror apparatus includes an input stage receiving an input current, $I_{in}$, and no additional bias current. The apparatus includes at least one output stage coupled to mirror the input current as an output current $I_{out}$. The input and output stages include insulated gate transistors. A minimum required voltage drop ($V_{in}$) across the input stage is approximately $2V_{on}+2V_{th}$, wherein $V_{th}$ is a threshold voltage of a selected one of the insulated gate transistors, wherein $V_{on}$ is a drain-to-source saturation voltage of the selected transistor. A minimum required voltage drop ($V_{out}$) across the output stage is approximately $2V_{on}$.

12 Claims, 6 Drawing Sheets

400

WIDE-SWING CASCODE CURRENT MIRROR

FIELD OF THE INVENTION

This invention relates to the field of analog circuit design particularly current mirrors.

BACKGROUND

A current mirror is a circuit that copies or "mirrors" a reference current in one active device by controlling a current in another active device. The current mirror may function as a current source or a current sink. Current mirrors are often used to provide bias currents or to serve as an active load.

An ideal current mirror has an infinite output resistance that is independent of voltage. In practice, however, the output resistance is finite. In addition, a functional current mirror requires a voltage drop across its input and output stages. The size of the required voltage drop limits one or more of the input current range, the output current range, or the size of the load being driven. The required voltage drop is an overhead that limits the signal swing available for the input or output or both. The required voltage drop becomes increasingly important as the supply level is reduced.

SUMMARY

One embodiment of a current mirror apparatus includes an input stage receiving an input current, $I_{in}$, and no additional bias current. The apparatus includes at least one output stage coupled to mirror the input current as an output current $I_{out}$. The input and output stages include insulated gate transistors. A minimum required voltage drop ($V_{in}$) across the input stage is approximately $2V_{on}+2V_{th}$, wherein $V_{th}$ is a threshold voltage of a selected one of the insulated gate transistors, wherein $V_{on}$ is a drain-to-source saturation voltage of the selected transistor. A minimum required voltage drop ($V_{out}$) across the output stage is approximately $2V_{on}$.

Another embodiment of a current mirror apparatus includes an input stage receiving an input current, $I_{in}$, and no additional bias current. The apparatus includes a plurality (n) of output stages coupled to mirror the input current as output currents $I_{out_1}$, $I_{out_2}$, . . . $I_{out_n}$. The input and output stages include insulated gate transistors. A minimum required voltage drop ($V_{in}$) across the input stage is approximately $2V_{on}+2V_{th}$, wherein $V_{th}$ is a threshold voltage of a selected one of the insulated gate transistors, wherein $V_{on}$ is a drain-to-source saturation voltage of the selected transistor. A minimum required voltage drop ($V_{out}$) across the output stage is approximately $2V_{on}$.

Other features and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Figure 1:
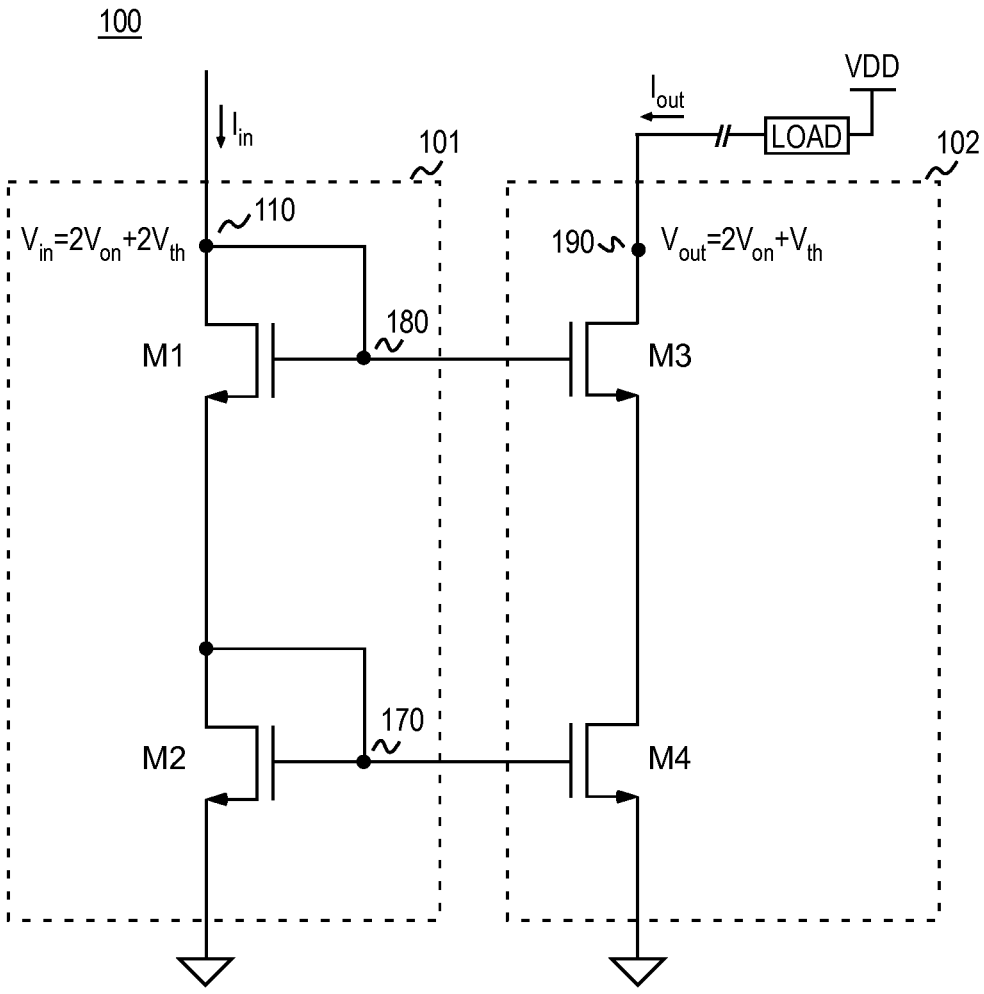
Prior Art FIG. 1
FIG. 1 illustrates a prior art cascode current mirror.

FIG. 1 illustrates a prior art current mirror 100. This configuration is sometimes referred to as a stacked cascode current mirror. A cascode configuration is used to increase the output impedance of a current mirror.

In the illustrated embodiment, the current mirror is constructed from metal oxide semiconductor field effect transistors (MOSFETs). Although the current mirror is illustrated with n-type MOSFETs, the current mirror may alternatively be constructed from p-type MOSFETs. Transistors M1, M2 form the input stage 101 of the current mirror. Transistors M3, M4 form the output stage 102 of the current mirror.

The subscripts "d", "g", and "s" are used to reference the drain, gate, and source terminals, respectively, of all of the devices. Additional subscripts may be added to distinguish the terminals of a specific device.

A minimum drain-to-source voltage, $V_{on}$, may be defined as follows:

$$V_{on}=V_{gs}-V_{th},$$

where $V_{on}$ is the drain-to-source voltage at the boundary of the active or saturation region of the MOSFET (i.e., the boundary between the triode and saturation regions), $V_{gs}$ is the gate-to-source voltage, and $V_{th}$ is the threshold voltage of the transistor. $V_{th}$ is independent of the current through the device. $V_{on}$, however, does depend upon current. $V_{on}$ may alternatively be referred to as the drain-to-source saturation voltage, $V_{dsat}$.

The voltage at node 110 (i.e., $V_{110}$) corresponds to the voltage drop, $V_{in}$, across the input stage 101 of the current mirror. The voltage at node 190 (i.e., $V_{190}$) corresponds to the voltage drop, $V_{out}$, across the output stage 102 of the current mirror. $V_{in}$ and $V_{out}$ establish compliance limits for the current mirror. The voltage supply, load, and currents $I_{in}$ and $I_{out}$ must allow at least the minimum voltage drops for the current mirror to operate.

$I_{in}$ represents the current to be mirrored as $I_{out}$. $I_{in}$ can be established by various means including a resistor coupled to a supply voltage, or a current source.

The drain current flowing through M1 is also the current $I_{in}$. The same drain current flows through M2. The drain current of M2 is mirrored by transistor M4. Any scaling of the mirrored current depends upon the relative W/L ratios of transistors M2 and M4 such that $I_{out}$ is proportional $I_{in}$ (i.e., $I_{out} \alpha I_{in}$). For same-sized transistors, $I_{out}=I_{in}$. The input and output stages require:

$$V_{in} \geqq 2V_{on}+2V_{th}$$

$$V_{out} \geqq 2V_{on}+V_{th}$$

These voltage amounts represent the minimum voltage drop across the input and output stages. These minimum voltage drops represent overhead requirements for the current mirror input and output stages.

Unless otherwise noted, illustrated transistors are presumed to have the same width (W) and length (L) such that they are same-sized in order to have the same $V_{on}$ and $V_{th}$. Accordingly, subscripts differentiating between the $V_{on}$ or $V_{th}$ of different transistors (e.g., $V_{on_M1}$, $V_{on_M2}$, etc.) will be omitted except when size differences require acknowledgement of the distinction.

Figure 2:
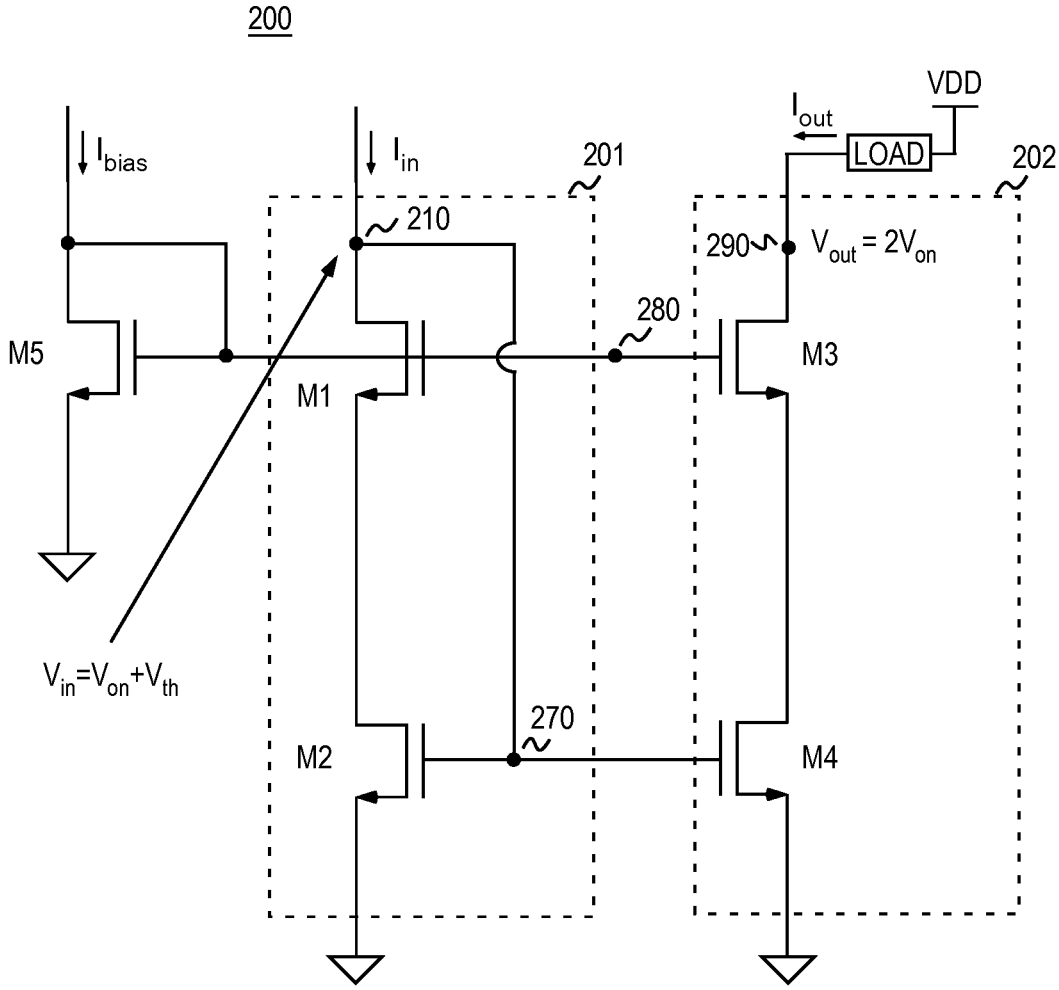
Prior Art FIG. 2
FIG. 2 illustrates another prior art cascode current mirror.

FIG. 2 illustrates another cascode current mirror 200. Transistors M1, M2 form the input stage 201. Transistors M3, M4 form an output stage 202. Transistor M5 is used in conjunction with a bias current to generate a bias voltage at node 280 for the gate of transistor M4 of the output stage.

The voltage at node 210 (i.e., $V_{210}$) corresponds to the voltage drop, $V_{in}$, across the input stage 201 of the current mirror. The voltage at node 290 (i.e., $V_{290}$) corresponds to the voltage drop, $V_{out}$, across the output stage 202 of the current mirror. The required voltage drop at the input stage 201 is:

$$V_{in} \geqq V_{on} + V_{th}$$

The output stage 202 requires:

$$V_{out} \geqq 2V_{on}$$

Thus the current mirror of FIG. 2 enables a larger signal swing at the input (due to the smaller $V_{in}$) and at the output (due to the smaller $V_{out}$) as compared to the current mirror of FIG. 1. However, this improvement comes at the cost of requiring an additional bias current and an additional component such as M5 to receive that bias current. The additional bias current must be routed to every location that replicates the input current or a scaled version of the input current (i.e., for every instance of an output stage 202).

Figure 3:
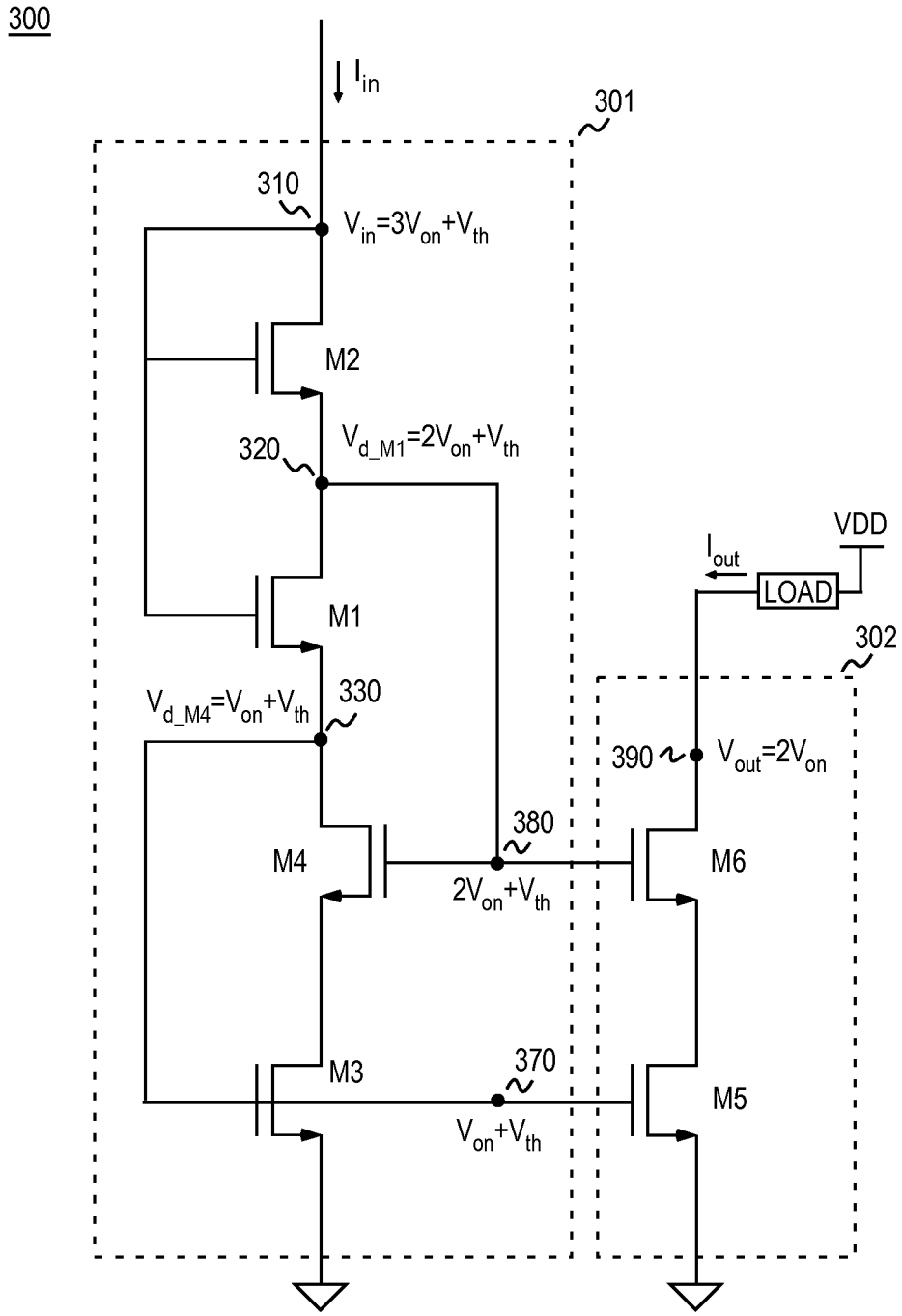
Prior Art FIG. 3
FIG. 3 illustrates a prior art cascode current mirror.

FIG. 3 illustrates another prior art cascode current mirror 300. This current mirror is known as the "Sooch current mirror". Transistors M1, M2, M3, M4 form the input stage 301. Transistors M5, M6 form the output stage 302. The voltage at node 310 (i.e., $V_{310}$) corresponds to the voltage drop, $V_{in}$, across the input stage 301 of the current mirror. The voltage at node 390 (i.e., $V_{390}$) corresponds to the voltage drop, $V_{out}$, across the output stage 302 of the current mirror.

Transistors M1-M6 are insulated gate field effect transistors. Transistor M2 operates in the saturated region due to the connection of its drain to gate. M1 is operating in the triode region. The relative aspect ratios of M1 and M2 are selected to provide a $V_{ds_m1}=V_{on_M2}$. This occurs when the width/length ratio of M2 is three times that of M1.

The voltage $V_{370}=V_{on}+V_{th}$. This same voltage is appears at the drain of transistor M4 (i.e., $V_{d_M4}=V_{on}+V_{th}$). Given that $V_{ds_M1}=V_{on}$, the result for the voltage at the drain of M1 and the gate of M4 is $V_{d_M1}$, $V_{g_M4}=2V_{on}+V_{th}$. Given M2's operation in the saturated region, $V_{ds_M2}=V_{on}$ yielding a voltage drop across the input stage 301 of $V_{in}=3V_{on}+2V_{th}$. For the output stage 302 of the current mirror, the voltage drop $V_{out}=2V_{on}$. Node voltages at nodes 320, 330, 370 and 380 are provided to illustrate the derivation of the minimum required voltage drops.

Although the voltage across the output stage is on par with the current mirror of FIG. 2 without the need for the additional bias current or bias voltage, the greater required voltage drop across the input stage 301 can create difficulties with respect to realizing a desired $I_{in}$. The voltage margin between a voltage supply such as VDD and the input of the current mirror of FIG. 3 is less than what is available with the current mirrors of FIGS. 1 and 2.

The minimum required voltage drops across the input and output stages of current mirror 300 are summarized as follows:

$$V_{in} \geqq 3V_{on} + 2V_{th}$$

$$V_{out} \geqq 2V_{on}$$

Figure 4:
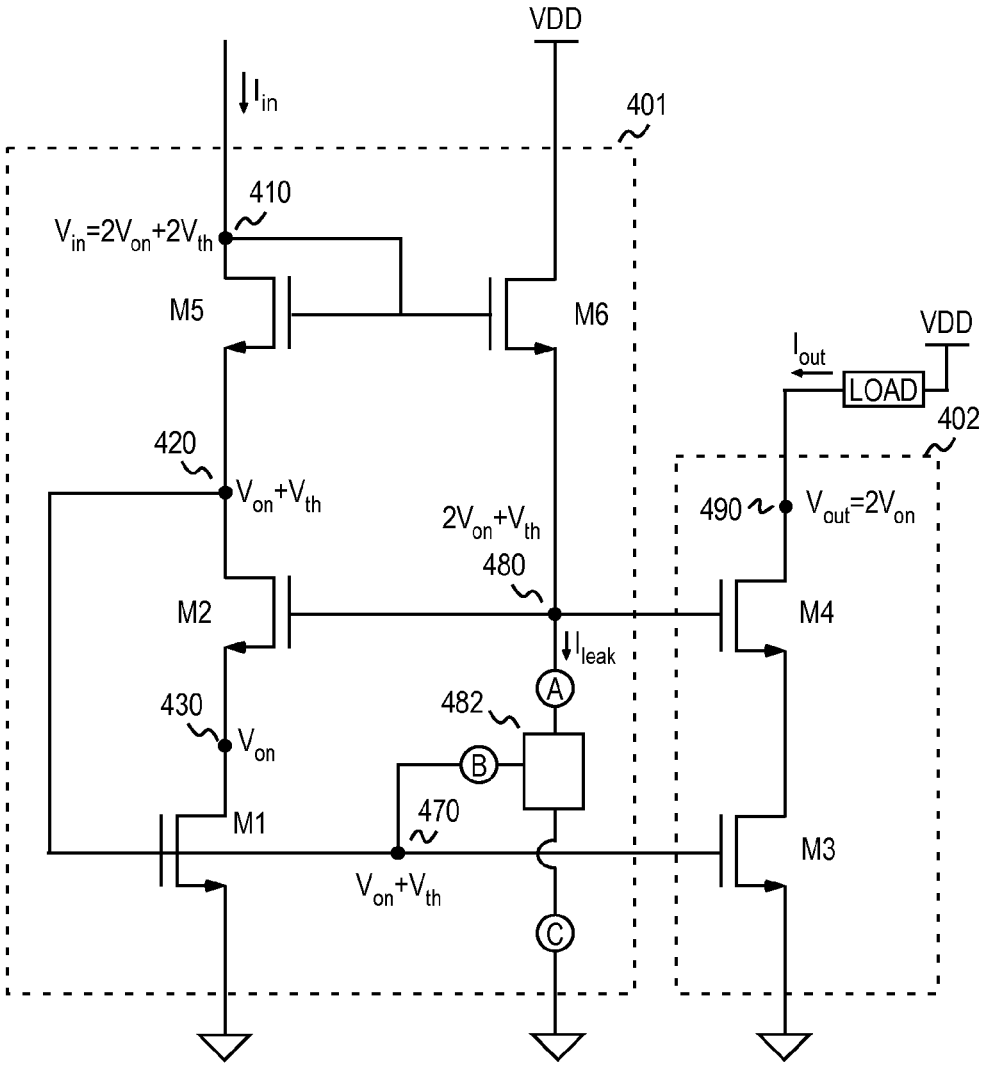
FIG. 4 illustrates one embodiment of a cascode current mirror.

FIG. 4 illustrates a cascode current mirror 400. Transistors M1, M2, M5, M6 form the input stage 401. Transistors M3, M4 form the output stage 402. The voltage at node 410 (i.e., $V_{410}$) corresponds to the voltage drop, $V_{in}$, across the input stage 401 of the current mirror. The voltage at node 490 (i.e., $V_{490}$) corresponds to the voltage drop, $V_{out}$, across the output stage 402 of the current mirror.

M3 mirrors the current through M1. Transistors M2 and M4 are the cascode transistors. Transistors M5 and M6 serve to generate the appropriate bias voltage for transistor M1 without an additional current source. Leakage path 482 is provided such that a very small leakage current can be established to bias M6 in the saturated mode of operation.

Figure 5:
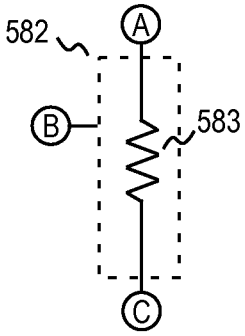
FIG. 5 illustrates an alternative embodiment for the leakage path of FIG. 4.
Figure 7:
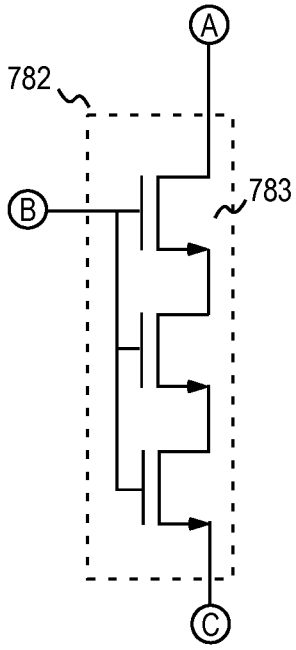
FIG. 7 illustrates an alternative embodiment for the leakage path of FIG. 4.
Figure 6:
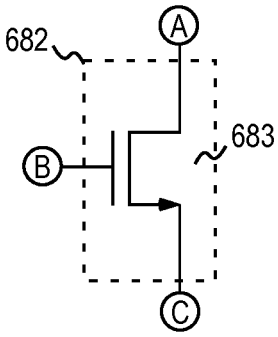
FIG. 6 illustrates an alternative embodiment for the leakage path of FIG. 4.

Alternative embodiments for leakage path 482 are illustrated in FIGS. 5-7. With respect to FIG. 5, the leakage path 582 may comprise a resistor 583. With respect to FIG. 6, the leakage path 682 may comprise a transistor 683. With respect to FIG. 7, the leakage path 782 may comprise a plurality of series-coupled transistors 783. Connection nodes A, B, and C illustrate how the constituent components of leakage paths 582, 682, and 782 are connected to the circuitry of FIG. 4 in order to substitute leakage paths 582, 682, or 782 for leakage path 482.

Referring to FIG. 4, the gate-to-source voltage for transistor M6 is very close to $V_{th}$ due to the small leakage current, $I_{leak}$. $V_{on_M6}$ is very small because the leakage current (which is also the drain current of M6) is very small. Accordingly $V_{on_M6}$ is negligible such that $V_{gs_M6} \approx V_{th}$.

The drain current for M5 is $I_{in}$ which is considerably larger than $I_{leak}$. Accordingly, $V_{on_M5}$ is not negligible. The gate-to-source voltage for M5 is $V_{on}+V_{th}$.

If M2 and M5 are sized approximately the same (e.g., same W/L aspect ratios), then $V_{on_M5}=V_{on_M2}$ due to $I_{in}$ likewise flowing through M2. If M1 and M6 are sized approximately the same, then $V_{th_M1}=V_{th_M6}$. Then the drain-to-source voltage for M1 may be calculated as follows:

$$\begin{aligned} V_{ds_M1} &= V_{gs_M1} + V_{gs_M5} - V_{gs_M6} - V_{gs_M2} \\ &= V_{on_M1} + V_{th_M1} + V_{on_M5} + V_{th_M5} - V_{th_M6} - \\ &\quad (V_{on_M2} + V_{th_M2}) \\ &= V_{on_M1} \end{aligned}$$

M5 and M6 act to add the $V_{on_M2}$ of M2 to the node voltage at 420 (because M5 is sized the same as M2). M5 and M6 produce a voltage at node 480 such that $V_{480}=V_{on_M1}+V_{on_M5}+V_{th_M5}$. The drain-to-source voltage of M1 may be calculated as $V_{ds_M1}=V_{480}-V_{gs_M2}$. Similarly, the gate-to-source voltage of M2 may be calculated as $V_{gs_M2}=V_{on_M2}+V_{th_M2}$. Substitution leads to $V_{ds_M1}=V_{on_M1}+V_{on_M5}+V_{th_M5}-V_{on_M2}-V_{th_M2}$. Given the matched sizes of M2 and M5, $V_{th_M2}=V_{th_M5}$. Due to the same drain current, $I_{in}$, and the matched sizes of M2 and M5, $V_{on_M2}=V_{on_M5}$. Accordingly, the computation for the drain-to-source voltage of M1 may be simplified to $V_{ds_M1}=V_{on_M1}$, which matches the value previously determined by other means. M5 and M6 co-operate to replicate $V_{on_M2}$ for application to the gate of M2. This causes M2 to force $V_{on_M1}$ on the drain of M1.

Given that all transistors are of the same type (i.e., n-type or p-type insulated gate transistors), they will tend to track one another across process, voltage, and temperature variations such that the circuit is robust across a large temperature range despite manufacturing variations. If necessary, M5 and M6 can be scaled to ensure sufficient margin in the event of a mismatch.

The minimum required voltage drops can be summarized as follows:

$$V_{in} \geqq 2V_{on} + 2V_{th}$$

$$V_{out} \geqq 2V_{on}$$

Thus the minimum voltage drop constraint for the input stage 401 is at least as good as the same constraints for FIGS. 1 and 3. The output stage 402 minimum voltage drop constraint is as good as the best of the current mirrors of FIGS. 1-3.

Table I summarizes the headroom requirements and current reference requirements for the current mirrors of FIGS. 1-4 (the first current reference is the current being mirrored).

TABLE I

| Architecture | $V_{in}$ | $V_{out}$ | # Current References |
|---|---|---|---|
| FIG. 1 | $2V_{on} + 2V_{th}$ | $2V_{on} + V_{th}$ | 1 |
| FIG. 2 | $V_{on} + V_{th}$ | $2V_{on}$ | 2 |
| FIG. 3 | $3V_{on} + 2V_{th}$ | $2V_{on}$ | 1 |
| FIG. 4 | $2V_{on} + 2V_{th}$ | $2V_{on}$ | 1 |

The current mirror of FIG. 4 offers an output headroom requirement on par with the current mirrors of FIGS. 2-3 and better than the output headroom requirement of FIG. 1. The current mirror of FIG. 4 also offers an input headroom requirement that is as low as or lower than the current mirrors of FIGS. 1 and 3. Although the current mirror of FIG. 2 has the least restrictive input headroom, the requirement of the additional bias current and bias voltage routing may render the current mirror of FIG. 2 unsuitable for some applications.

In various embodiments the transistors of FIG. 4 are insulated gate transistors. In one embodiment such transistors are metal oxide semiconductor field effect transistors. Although illustrated with n-type devices, the current mirrors can alternatively be constructed from p-type devices.

The relationship between $I_{in}$ and $I_{out}$ can be modeled as follows:

$$I_{out} = \alpha + \beta I_{in}$$

where $\alpha$ is an offset and $\beta$ is a scaling factor. Ideally $\alpha=0$ such that $I_{out} \propto I_{in}$ and $$\frac{I_{out}}{I_{in}} = \beta.$$

In one embodiment $\beta=1$ to provide a 1:1 scaling. In alternative embodiments, $\beta \neq 1$. For example, in one embodiment $\beta>1$ such that $I_{out}$ is a scaled up version of $I_{in}$.

The scaling factor $\beta$ is determined by the ratio of the W/L ratios of transistors M3 and M1 as follows:

$$\beta = \frac{(W_{M3}/L_{M3})}{(W_{M1}/L_{M1})}$$

wherein $(W_{M3}/L_{M3})$ is the width-to-length ratio of transistor M3 and $(W_{M1}/L_{M1})$ is the width-to-length ratio of transistor M1.

Through the appropriate sizing and elimination of offsets by the appropriate fabrication processes, the $\beta$ ratio for the wide swing current mirror of FIG. 4 can be selected to accommodate typically desired scaling factors including $\beta \approx 1$, $\beta \neq 1$, $\beta>1$, etc. (The symbol "≈" is interpreted as "approximately equal to" or "substantially the same as".)

Figure 8:
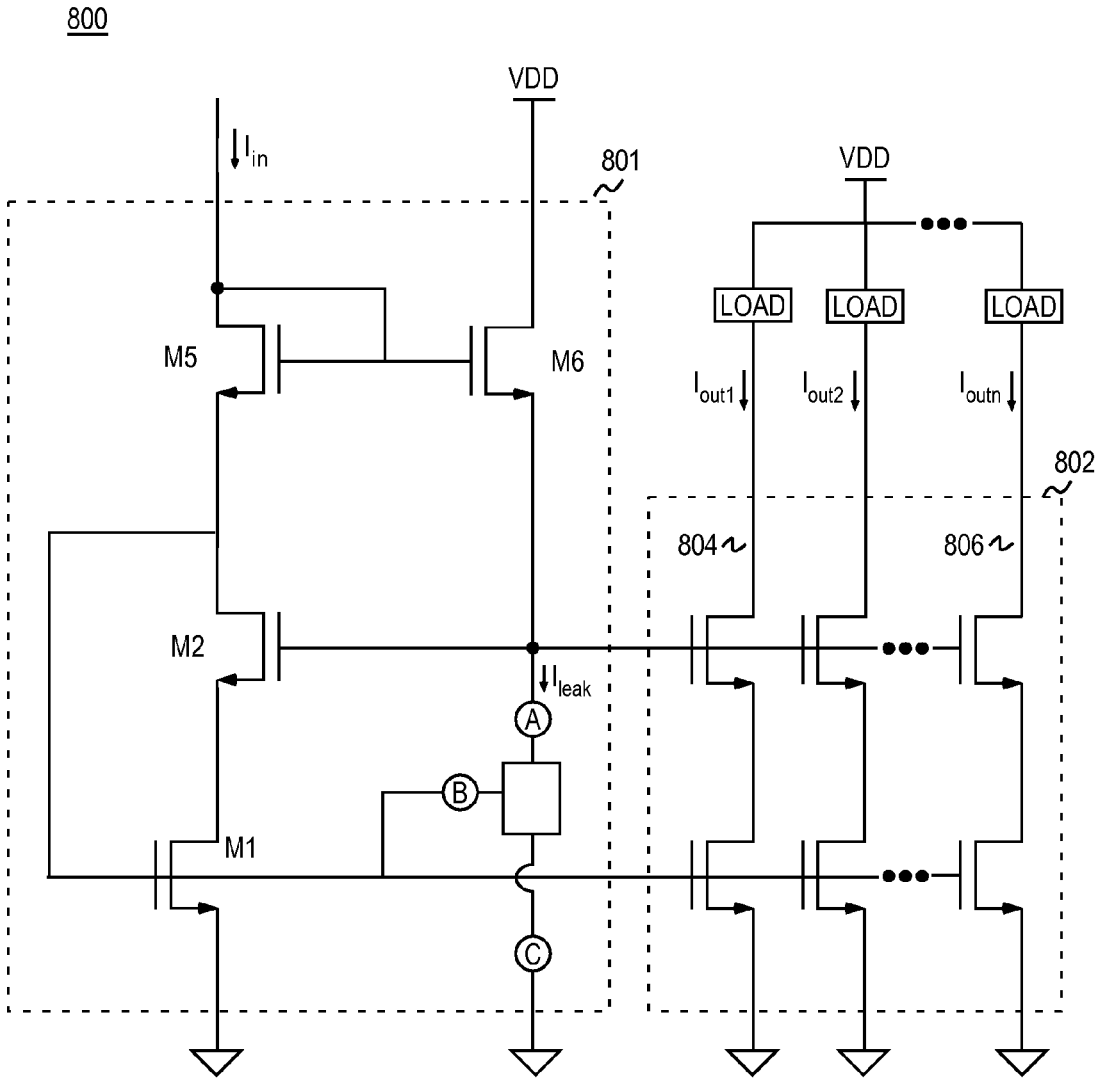
FIG. 8 illustrate one embodiment of a cascode current mirror having a plurality of output stages.

FIG. 8 illustrates one embodiment of the wide swing cascode current mirror 800 having a plurality (n) of output stages 802. In this fashion a single input stage 810 can be used to create multiple output currents, $I_{out_1}, I_{out_2}, \ldots I_{out_n}$. The output stages 804, 806 can be fabricated to have the same $\beta$ but are not required to have the same $\beta$.

Thus in one embodiment, the current mirror is designed with a plurality (n) of output stages such that $$I_{out_j} \approx I_{in} \forall i \in \{1 \ldots n\}$$

which states that $I_{out_j}$ is approximately equal to $I_{in}$ for all j (where j is any element of the set of indices used to distinguish the n output stages.) Given that $$I_{in} = \frac{1}{\beta_1} I_{out_1} = \frac{1}{\beta_2} I_{out_2} \ldots = \frac{1}{\beta_n} I_{out_n},$$

embodiments having all output stages providing the same output current can be accomplished by setting $\beta_j \approx \beta_k \forall j,k \in \{1 \ldots n\}$. In other words, there is no output stage j having a $\beta$ substantially distinct from that of any other output stage k (i.e., $\beta_j \approx \beta_k$ for all j, k).

In another embodiment there is at least one output stage j that has a $\beta$ distinct from that of another output stage k (i.e., for $j,k \in \{1 \ldots n\}$, there exists a j and a k such that $\beta_j \neq \beta_k$,).

Various current mirror architectures have been described for a wide swing current mirror including single stage, multiple stage, and scaled mirroring. Other modifications may be made to improve the performance of the current mirror. Referring to FIG. 4, for example, resistive degeneration can be applied to reduce mismatch by connecting the drains of transistors M1 and M3 to signal ground via resistors instead of directly to signal ground as illustrated.

In the preceding detailed description, the invention is described with reference to specific exemplary embodiments thereof. Various modifications and changes may be made thereto without departing from the broader scope of the invention as set forth in the claims. The specification and drawings are, accordingly, to be regarded in an illustrative rather than a restrictive sense.

What is claimed is:

1. A current mirror apparatus comprising:

an input stage receiving an input current, $I_{in}$, and no additional bias current; and at least one output stage coupled to mirror the input current as an output current $I_{out}$, the input and output stages comprising insulated gate transistors, wherein a minimum required voltage drop ($V_{in}$) across the input stage is approximately $2V_{on}+2V_{th}$, wherein a minimum required voltage drop ($V_{out}$) across the output stage is approximately $2V_{on}$ wherein $V_{th}$ is a threshold voltage of a selected one of the insulated gate transistors, wherein $V_{on}$ is a drain-to-source saturation voltage of the selected transistor.

2. The apparatus of claim 1 wherein $I_{out} \approx I_{in}$.

3. The apparatus of claim 1 wherein $$\frac{I_{out}}{I_{in}} \approx \beta,$$

wherein $\beta \neq 1$.

4. The apparatus of claim 1 wherein $$\frac{I_{out}}{I_{in}} \approx \beta,$$

wherein $\beta>1$.

5. The apparatus of claim 1 wherein the insulated gate transistors are n-type transistors.

6. The apparatus of claim 1 wherein the insulated gate transistors are p-type transistors.

7. A current mirror apparatus comprising:

an input stage receiving an input current, $I_{in}$, and no additional bias current; and a plurality (n) of output stages coupled to mirror the input current as output currents $I_{out_1}$, $I_{out_2}$, . . . $I_{out_n}$, the input and output stages comprising insulated gate transistors, wherein a minimum required voltage drop ($V_{in}$) across the input stage is approximately $2V_{on}+2V_{th}$, wherein a minimum required voltage drop ($V_{out}$) across the output stages is approximately $2V_{on}$ wherein $V_{th}$ is a threshold voltage of a selected one of the insulated gate transistors, wherein $V_{on}$ is a drain-to-source saturation voltage of the selected transistor.

8. The apparatus of claim 7 wherein $I_{out_j} \approx_{in} \forall j \in \{1 \ldots n\}$.

9. The apparatus of claim 7 wherein $$\frac{I_{out_j}}{I_{in}} \approx \beta_j,$$

wherein $\beta_j \approx \beta_k \forall j,k \in \{1 \ldots n\}$.

10. The apparatus of claim 7 wherein $$\frac{I_{out_j}}{I_{in}} \approx \beta_j,$$

wherein for $j,k \in \{1 \ldots n\}$ there is at least one j and one k such that $\beta_j \neq \beta_k$.

11. The apparatus of claim 7 wherein the insulated gate transistors are n-type transistors.

12. The apparatus of claim 7 wherein the insulated gate transistors are p-type transistors.

* * * * *

UNITED STATES PATENT AND TRADEMARK OFFICE

CERTIFICATE OF CORRECTION

PATENT NO. : 8,450,992 B2
APPLICATION NO. : 12/495412
DATED : May 28, 2013
INVENTOR(S) : Ion C. Tesu et al.

It is certified that error appears in the above-identified patent and that said Letters Patent is hereby corrected as shown below:

In the Claims

In claim 8, column 8, line 1, delete "in," and insert --$I_{in}$--.

Signed and Sealed this
Second Day of July, 2013

Teresa Stanek Rea
*Acting Director of the United States Patent and Trademark Office*